US011771167B2

(12) United States Patent
Pietrzak

(10) Patent No.: US 11,771,167 B2
(45) Date of Patent: Oct. 3, 2023

(54) CONNECTOR

(71) Applicant: MIPS AB, Täby (SE)

(72) Inventor: Christopher Pietrzak, Täby (SE)

(73) Assignee: MIPS AB

( * ) Notice: Subject to any disclaimer, the term of this patent is extended or adjusted under 35 U.S.C. 154(b) by 280 days.

(21) Appl. No.: 16/971,343

(22) PCT Filed: Feb. 19, 2019

(86) PCT No.: PCT/EP2019/054113

§ 371 (c)(1),
(2) Date: Aug. 20, 2020

(87) PCT Pub. No.: WO2019/162281

PCT Pub. Date: Aug. 29, 2019

(65) Prior Publication Data

US 2021/0007435 A1 Jan. 14, 2021

(30) Foreign Application Priority Data

Feb. 22, 2018 (GB) ..... 1802898

(51) Int. Cl.
*A42B 3/12* (2006.01)
*A44B 18/00* (2006.01)

(52) U.S. Cl.
CPC ..... *A42B 3/125* (2013.01); *A44B 18/0069* (2013.01); *Y10T 24/2708* (2015.01)

(58) Field of Classification Search
CPC ..... Y10T 24/2708; A44B 18/0069
USPC ..... 24/306
See application file for complete search history.

(56) References Cited

U.S. PATENT DOCUMENTS

| | | | | |
|---|---|---|---|---|
| 5,100,393 | A * | 3/1992 | Johnson | A61M 25/02 24/302 |
| 9,474,316 | B2 | 10/2016 | Berry | |
| 2002/0062540 | A1* | 5/2002 | Nishida | A47G 11/006 24/570 |
| 2014/0366252 | A1 | 12/2014 | Mazzarolo et al. | |
| 2015/0089722 | A1 | 4/2015 | Berry | |
| 2017/0347736 | A1 | 12/2017 | Penner et al. | |
| 2020/0037690 | A1* | 2/2020 | Pomering | A42B 3/08 |
| 2021/0401104 | A1* | 12/2021 | Pomering | A42B 3/064 |

FOREIGN PATENT DOCUMENTS

| | | |
|---|---|---|
| WO | WO 2001/045526 | 6/2001 |
| WO | WO 2011/139224 | 11/2011 |
| WO | WO 2015/177747 | 11/2015 |

(Continued)

*Primary Examiner* — David M Upchurch
(74) *Attorney, Agent, or Firm* — Perkins Coie LLP

(57) ABSTRACT

A connector for connecting first and second parts of an apparatus, comprising: an inner region comprising a first anchor point on a first side thereof, the first anchor point being configured to connect the connector to the first part of the apparatus; two, or more, arms extending outward from an edge of the inner region, the arms being formed from a deformable material and configured to connect the connector to the second part of the apparatus; and the inner region further comprising a sliding surface on a second side thereof, opposite the first side, the sliding surface being configured to provide a low friction interface between the inner region and an opposing surface of the second part of the apparatus.

19 Claims, 9 Drawing Sheets

(56) References Cited

FOREIGN PATENT DOCUMENTS

| | | | | |
|---|---|---|---|---|
| WO | 2017/157765 | A1 | 9/2017 | |
| WO | 2017161459 | A1 | 9/2017 | |
| WO | WO 2017/157765 | | 9/2017 | |
| WO | WO-2017157765 | A1 * | 9/2017 | ..... A42B 3/064 |

* cited by examiner

CONNECTOR

RELATED APPLICATIONS

This application is a 35 USC § 371 National Stage application of International Application No. PCT/EP2019/054113, entitled "CONNECTOR," filed on Feb. 19, 2019, which claims the benefit of United Kingdom Patent Application No. 1802898.5, filed on Feb. 22, 2018 the disclosures of which applications are incorporated herein by reference in their entireties.

The present invention relates to a connector, which may be used to connect two parts of an apparatus, for example for connecting a liner or comfort padding to the remainder of a helmet.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets may be used in ice hockey, cycling, motorcycling, motor-car racing, skiing, snow-boarding, skating, skateboarding, equestrian activities, American football, baseball, rugby, cricket, lacrosse, climbing, golf, airsoft and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device for fixing the helmet to the user's head, and it is the attachment device that can vary in dimension to fit the user's head whilst the main body or shell of the helmet remains the same size. In some cases, comfort padding within the helmet can act as the attachment device. The attachment device can also be provided in the form of a plurality of physically separate parts, for example a plurality of comfort pads which are not interconnected with each other. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer called a liner. Nowadays, a protective helmet has to be designed so as to satisfy certain legal requirements which relate to inter alia the maximum acceleration that may occur in the centre of gravity of the brain at a specified load. Typically, tests are performed, in which what is known as a dummy skull equipped with a helmet is subjected to a radial blow towards the head. This has resulted in modern helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotation energy and/or redirecting it into translational energy rather than rotational energy.

Such oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include Mild Traumatic Brain Injuries (MTBI) such as concussion, and Severe Traumatic Brain Injuries (STBI) such as subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational force, such as the duration, amplitude and rate of increase, either concussion, SDH, DAI or a combination of these injuries can be suffered. Generally speaking, SDH occur in the case of accelerations of short duration and great amplitude, while DAI occur in the case of longer and more widespread acceleration loads.

In helmets such as those disclosed in WO 2001/045526 and WO 2011/139224 that may reduce the rotational energy transmitted to the brain caused by oblique impacts, the first and second parts of the helmet may be configured to slide relative to each other following an oblique impact. However, it remains desirable for the first and second parts to be connected such that the helmet retains its integrity during normal use, namely when not subject to an impact. It is therefore desirable to provide connectors that, whilst connecting first and second parts of a helmet together, permit movement of the first part relative to the second part under an impact. It is also desirable to provide connectors within a helmet that can be provided without substantially increasing the manufacturing costs and/or effort.

The connectors in WO 2017/157765 address some of issues mentioned above. However, they can be relatively fiddly and time-intensive to manufacture. The present invention aims to at least partially address this problem by providing an easy to manufacture connector that permits relative movement under impact.

According to an aspect of the invention there is provided a connector for connecting first and second parts of an apparatus, comprising: an inner region comprising a first anchor point on a first side thereof, the first anchor point being configured to connect the connector to the first part of the apparatus; two, or more, arms extending outward from an edge of the inner region, the arms being formed from a deformable material and configured to connect the connector to the second part of the apparatus; and the inner region further comprising a sliding surface on a second side thereof, opposite the first side, the sliding surface being configured to provide a low friction interface between the inner region and an opposing surface of the second part of the apparatus.

Optionally the arms extend from mutually opposite sides of the inner region.

In some embodiments, optionally, each arm extends in a direction substantially parallel to the sliding surface of the inner region. Optionally, each arm further comprises a second anchor point for connecting the arm to the second part of the apparatus.

In some embodiments, optionally, each arm extends away from the first anchor point and joins with the other arm to form a closed loop on the opposite side of the inner region to the first anchor point, the closed loop configured to loop around a portion of the second part of the apparatus.

Optionally, the arms comprise a second anchor point arranged opposite and facing the inner region configured to connect to a surface of the second part opposite the surface forming the sliding interface. Alternatively, the arms are optionally configured to loop around a portion of the second part of the apparatus to connect the connector thereto without a further anchor point for connecting the arms to the second part of the apparatus.

In some embodiments, optionally, the inner region comprises a portion of deformable material integrally formed with the arms and a plate of relatively stiff material compared to the deformable material. Optionally, the deformable material of the inner region at least partially covers one side of the plate. Alternatively, optionally, the deformable material of the inner region at least partially covers two opposing sides of the plate.

In some embodiments, optionally, the inner region comprises a plate of relatively stiff material compared to the deformable material, connected to the arms. Optionally, the plate comprises protrusions extending from an edge of the inner region and the plate is connected to the arms via the protrusions. Optionally, the deformable material of the arms at least partially covers one side of the protrusions. Alternatively, optionally, the deformable material of the arms at least partially covers two opposing sides of the protrusions.

Optionally, the plate is fixed to the deformable material by an adhesive. Alternatively, optionally, the plate is co-moulded with the deformable material.

Optionally, the plate is not fixed to the deformable material.

Optionally, the first anchor point is directly connected to the plate.

According to an aspect of the present invention there is provided a connector according to any one of the preceding claims, wherein the deformable material is substantially elastically deformable.

According to an aspect of the present invention there is provided a connector wherein the deformable material comprises an elasticated fabric, cloth or textile, or an elastomeric material.

Optionally, wherein the deformable material is a silicone elastomer.

According to an aspect of the present invention there is provided, a connector, wherein the arms of deformable material are configured to bias the inner region towards a first position, such that when the inner region is displaced away from the first position by sliding along the low friction interface, the arms of deformable material urge the inner region back into the first position.

According to an aspect of the present invention there is provided a connector, wherein the low friction interface is implemented by at least one of using at least one low friction material for the construction of the element forming at least one of the opposing surfaces, applying a low friction coating to at least one of the opposing surfaces, applying a lubricant to at least one of the opposing surfaces, and providing an unsecured additional layer of material between the opposing surfaces that has at least one low friction surface.

Optionally, the at least one second anchor point is configured to be detachably connected to the first part of the apparatus.

Optionally, the at least one second anchor point is configured to be detachably connected by at least one of a hook and loop connection, a snap-fit connection and a magnetic connection.

Optionally, the at least one second anchor point is configured to be non-releasably connected to the first part of the apparatus.

Optionally, wherein the at least one second anchor point is configured to be connected by an adhesive, stitching, or high frequency welding.

Optionally, wherein the first anchor point is configured to be detachably connected to the first part of the apparatus.

Optionally wherein the first anchor point is configured to be detachably connected by at least one of a hook and loop connection, a snap-fit connection and a magnetic connection.

Optionally, the first anchor point is configured to be non-releasably connected to the first part of the apparatus. Optionally, the first anchor point is configured to be connected by an adhesive, stitching, or high frequency welding.

Optionally, the connector further comprising one or more further arms extending outward from the edge of the inner region, the arms being formed from the deformable material and configured to connect the connector to the second part of the apparatus.

According to a second aspect of the invention, there is provided a liner for a helmet, comprising at least one connector according to the preceding aspect.

Optionally, the first anchor point of the at least one connector is configured to be connected to the helmet.

Optionally, the liner comprises comfort padding and optionally a layer of relatively hard material, compared to the comfort padding, provided more outwardly than the comfort padding.

According to a third aspect of the invention there is provided a helmet, comprising a liner according to the second aspect of the invention.

Optionally, the liner is removable from the helmet.

Optionally, the first anchor point of the at least one connector is connected to at least one of a relatively hard outer shell of the helmet, an energy absorbing layer of material in the helmet and a relatively hard layer of material provided more inwardly within the helmet than the energy absorbing material of the helmet.

Optionally, the helmet comprises in turn, an outer shell formed from a relatively hard material, one or more layers of energy absorbing material, an inner shell formed from a relatively hard material and the liner.

Optionally, a low friction interface is provided between the energy absorbing material and the inner shell.

Optionally, the low friction interface is implemented by at least one of using at least one low friction material for the construction of the inner shell and the energy absorbing material, applying a low friction coating to at least one of the opposing surfaces of the inner shell and the energy absorbing material, and applying a lubricant to at least one of the opposing surfaces of the inner shell and the energy absorbing material.

Optionally the first anchor point is attached to the helmet by a hook and loop connection.

According to a fourth aspect of the invention there is provided a helmet comprising a plurality of independent sections of comfort padding, each mounted to the helmet by at least one connector according to the first aspect of the invention.

Optionally, the helmet comprises in turn, an outer shell formed from a relatively hard material, one or more layers of energy absorbing material, an inner shell formed from a plurality of sections of relatively hard material, and the plurality of sections of comfort padding.

Optionally, a low friction interface is provided between the plurality of sections of inner shell and the energy absorbing material.

Optionally, the low friction interface is implemented by at least one of using at least one low friction material for the construction of the plurality of sections of inner shell and the energy absorbing material, applying a low friction coating to at least one of the opposing surfaces of the plurality of sections of inner shell and the energy absorbing material, and applying a lubricant to at least one of the opposing surfaces of the plurality of sections of inner shell and the energy absorbing material.

Optionally, the first anchor point is attached to the helmet by a hook and loop connection.

According to a fifth aspect of the present invention there is provided a set of a plurality of sections of comfort padding for use within a helmet, wherein at least one section of comfort padding comprises at least one connector.

Optionally, at least one section of comfort padding comprises at least one different type of connector.

According to a sixth aspect of the invention, there is provided a helmet comprising in turn: an outer shell formed from a relatively hard material, one or more layers of energy absorbing material, and a liner or a plurality of sections of comfort padding; at least one connector according to the first aspect of the invention connecting the liner or a section of comfort padding to the rest of the helmet; wherein a relatively hard coating is bonded to the outer surface of the liner or plurality of sections of comfort padding, to form a low friction interface between the relatively hard coating and the energy absorbing layer.

The invention is described in detail, below, with reference to the accompanying figures, in which.

Figure 18:
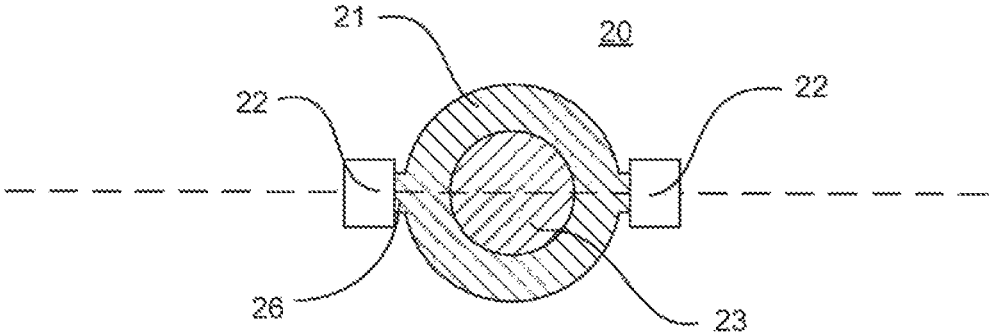
Figure 19:
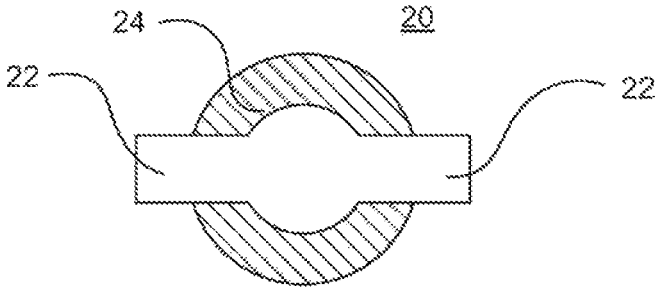
Figure 20:
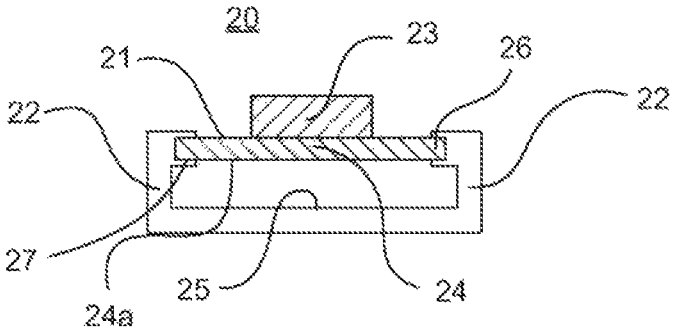

FIG. 18. depicts a top (plan) view of a connector according to a third embodiment of the present invention;

FIG. 19. depicts a bottom (plan) view, of this connector in FIG. 18;

FIG. 20 depicts a cross-sectional side view of the connector of FIG. 18.

The proportions of the thicknesses of the various layers in the helmets depicted in the figures have been exaggerated in the drawings for the sake of clarity and can of course be adapted according to need and requirements.

Figure 1:
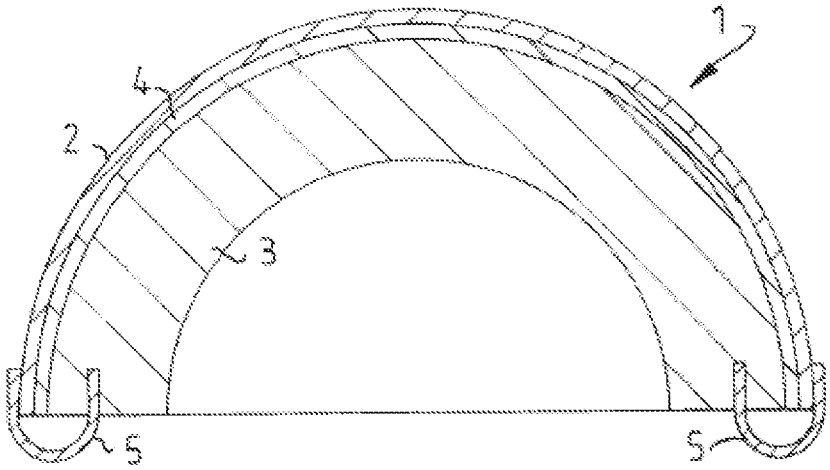
FIG. 1 depicts a cross-section through a helmet for providing protection against oblique impacts.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3 that is intended for contact with the head of the wearer.

Arranged between the outer shell 2 and the inner shell 3 is a sliding layer 4 or a sliding facilitator, which makes possible displacement between the outer shell 2 and the inner shell 3. In particular, as discussed below, a sliding layer 4 or sliding facilitator may be configured such that sliding may occur between two parts during an impact. For example, it may be configured to enable sliding under forces associated with an impact on the helmet 1 that is expected to be survivable for the wearer of the helmet 1. In some arrangements, it may be desirable to configure the sliding layer or sliding facilitator such that the coefficient of friction is between 0.001 and 0.3 and/or below 0.15.

Arranged in the edge portion of the helmet 1, in the FIG. 1 depiction, may be one or more connecting members 5 which interconnect the outer shell 2 and the inner shell 3. In some arrangements, the connectors may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may not be present at all.

Further, the location of these connecting members 5 can be varied (for example, being positioned away from the edge portion, and connecting the outer shell 2 and the inner shell 3 through the sliding layer 4).

The outer shell 2 is preferably relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, Twaron, carbon-fibre or Kevlar.

The inner shell 3 is considerably thicker and acts as an energy absorbing layer. As such, it is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names Poron™ and D30™. The construction can be varied in different ways, which emerge below, with, for example, a number of layers of different materials.

Inner shell 3 is designed for absorbing the energy of an impact. Other elements of the helmet 1 will absorb that energy to a limited extent (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

A number of different materials and embodiments can be used as the sliding layer 4 or sliding facilitator, for example oil, Teflon, microspheres, air, rubber, polycarbonate (PC), a fabric material such as felt, etc. Such a layer may have a thickness of roughly 0.1-5 mm, but other thicknesses can also be used, depending on the material selected and the performance desired. The number of sliding layers and their positioning can also be varied, and an example of this is discussed below (with reference to FIG. 3B).

As connecting members 5, use can be made of, for example, deformable strips of plastic or metal which are anchored in the outer shell and the inner shell in a suitable manner.

Figure 2:
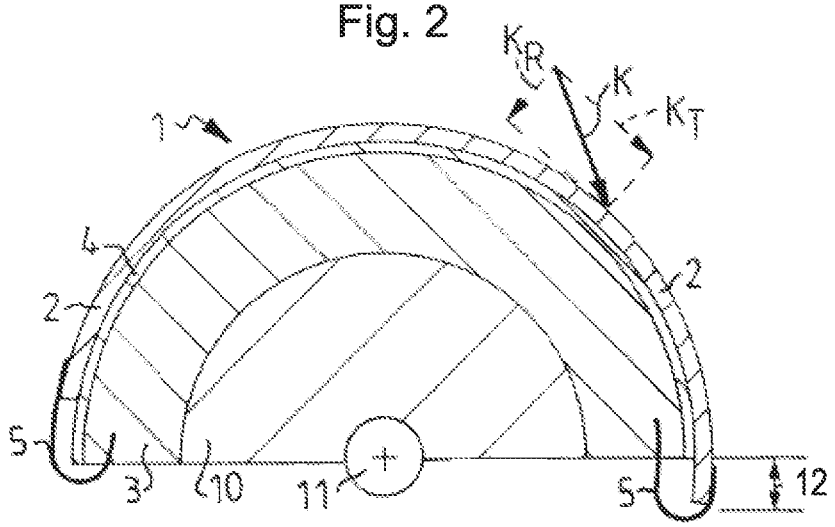
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull when the helmet 1 is subjected to an oblique impact K. The impact force K gives rise to both a tangential force KT and a radial force KR against the protective helmet 1. In this particular context, only the helmet-rotating tangential force KT and its effect are of interest.

As can be seen, the force K gives rise to a displacement 12 of the outer shell 2 relative to the inner shell 3, the connecting members 5 being deformed. A reduction in the torsional force transmitted to the skull 10 of roughly 25% can be obtained with such an arrangement. This is a result of the sliding motion between the inner shell 3 and the outer shell 2 reducing the amount of energy which is transferred into radial acceleration.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3).

Figure 3A:
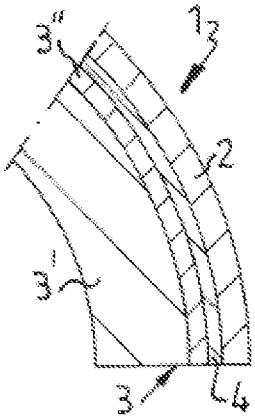
FIGS. 3A, 3B & 3C show variations of the structure of the helmet of FIG. 1.
Figure 3B:
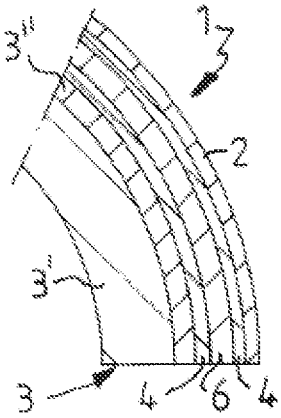
Figure 3C:
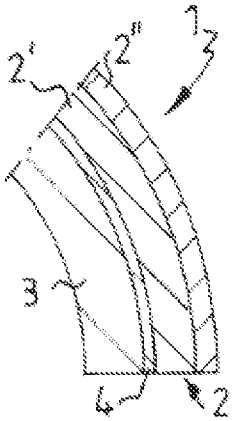

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" is preferably harder than the inner layer 3', to help facilitate the sliding with respect to outer shell 2. In FIG. 3*b*, the inner shell 3 is constructed in the same manner as in FIG. 3*a*. In this case, however, there are two sliding layers 4, between which there is an intermediate shell 6. The two sliding layers 4 can, if so desired, be embodied differently and made of different materials. One possibility, for example, is to have lower friction in the outer sliding layer than in the inner. In FIG. 3*c*, the outer shell 2 is embodied differently to previously. In this case, a harder outer layer 2" covers a softer inner layer 2'. The inner layer 2' may, for example, be the same material as the inner shell 3.

Figure 4:
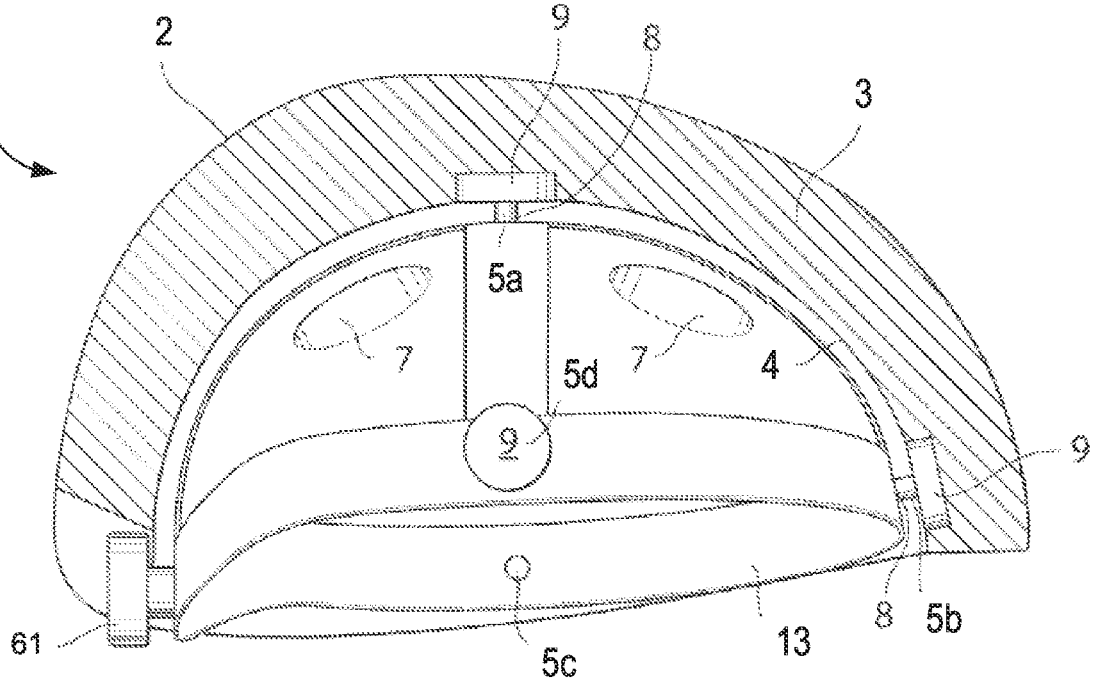
FIG. 4 is a schematic drawing of a another protective helmet.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An attachment device 13 is provided, for attachment of the helmet 1 to a wearer's head. As previously discussed, this may be desirable when energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap of textile or a net could form the attachment device 13.

Although the attachment device 13 is shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 61 for adjusting the diameter of the head band of the attachment device 13 for the particular wearer. In other arrangements, the head band could be an elastic head band in which case the adjustment device 61 could be excluded.

A sliding facilitator 4 is provided radially inwards of the energy absorbing layer 3. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13, in the same manner as discussed above. The sliding facilitator 4 may be a material having a low coefficient of friction, or may be coated with such a material.

As such, in the FIG. 4 helmet, the sliding facilitator may be provided on or integrated with the innermost side of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself can be adapted to act as a sliding facilitator 4 and may comprise a low friction material.

In other words, the sliding facilitator 4 is provided radially inwards of the energy absorbing layer 3. The sliding facilitator can also be provided radially outwards of the attachment device 13.

When the attachment device 13 is formed as a cap or net (as discussed above), sliding facilitators 4 may be provided as patches of low friction material.

The low friction material may be a waxy polymer, such as PTFE, ABS, PVC, PC, Nylon, PFA, EEP, PE and UHMWPE, or a powder material which could be infused with a lubricant. The low friction material could be a fabric material. As discussed, this low friction material could be applied to either one, or both of the sliding facilitator and the energy absorbing layer.

The attachment device 13 can be fixed to the energy absorbing layer 3 and/or the outer shell 2 by means of fixing members 5, such as the four fixing members 5*a*, 5*b*, 5*c* and 5*d* in FIG. 4. These may be adapted to absorb energy by deforming in an elastic, semi-elastic or plastic way. However, this is not essential. Further, even where this feature is present, the amount of energy absorbed is usually minimal in comparison to the energy absorbed by the energy absorbing layer 3 during an impact.

According to the embodiment shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

Figure 5:
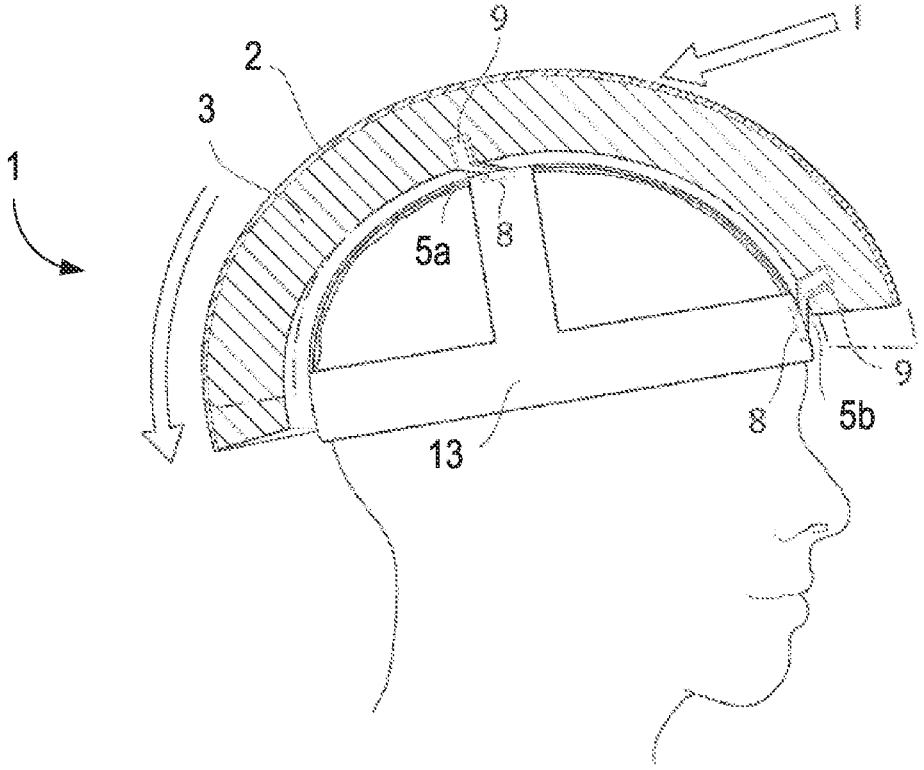
FIG. 5 depicts an alternative way of connecting the attachment device of the helmet of FIG. 4.

FIG. 5 shows an embodiment of a helmet similar to the helmet in FIG. 4, when placed on a wearer's head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some case a combination of plastic and elastic deformation in the fixing members 5 may occur, i.e. some fixing members 5 rupture, absorbing energy plastically, whilst other fixing members deform and absorb forces elastically.

In general, in the helmets of FIG. 4 and FIG. 5, during an impact the energy absorbing layer 3 acts as an impact absorber by compressing, in the same way as the inner shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain. The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries including MTBI and STBI such as subdural haematomas, SDH, blood vessel rapturing, concussions and DAI is thereby reduced.

Connectors of the present invention for connecting two parts of an apparatus are described below. It should be appreciated that these connectors may be used in a variety of contexts and are not to be limited to use within helmets. For example, they may be used in other devices that provide impact protection, such as body armour or padding for sports equipment. In the context of helmets, the connectors of the present invention may, in particular, be used in place of the previously known connecting members and/or fixing members of the arrangements discussed above.

Figure 6:
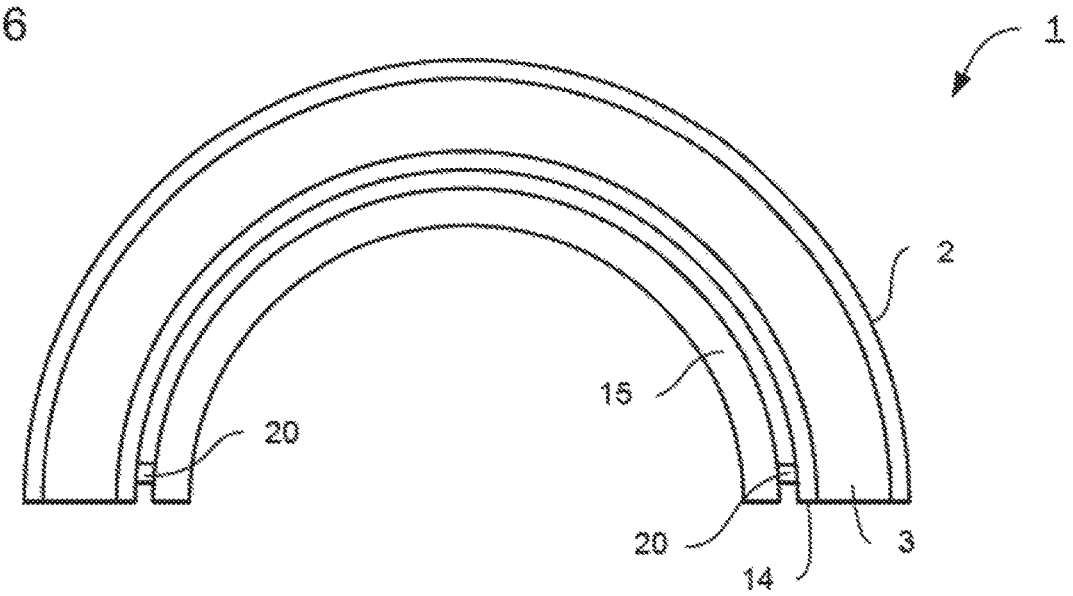
FIG. 6 depicts, in cross-section, a helmet according to an embodiment of the present invention.

In an embodiment of the invention, the connector may be used with a helmet 1 of the type shown in FIG. 6. The helmet shown in FIG. 6 has a similar configuration to that discussed above in respect of FIGS. 4 and 5. In particular, the helmet has a relatively hard outer shell 2 and an energy absorbing layer 3. A head attachment device is provided in the form of a helmet liner 15. The liner 15 may include comfort padding as discussed above. In general, the liner 15 and/or any comfort padding may not absorb a significant proportion of the energy of an impact in comparison with the energy absorbed by the energy absorbing layer 3.

The liner 15 may be removable. This may enable the liner to be cleaned and/or may enable the provision of liners that are modified to fit a specific wearer.

Between the liner 15 and the energy absorbing layer 3, there is provided an inner shell 14 formed from a relatively hard material, namely a material that is harder than the energy absorbing layer 3. The inner shell 14 may be moulded to the energy absorbing layer 3 and may be made from any of the materials discussed above in connection with the formation of the outer shell 2.

In the arrangement of FIG. 6, a low friction interface is provided between the inner shell 14 and the liner 15. This may be implemented by the appropriate selection of at least one of the material used to form the outer surface of the liner 15 or the material used to form the inner shell 14. Alternatively or additionally, a low friction coating may be applied to at least one of the opposing surfaces of the inner shell 14 and the liner 15. Alternatively or additionally, a lubricant may be applied to at least one of the opposing surfaces of the inner shell 14 and the liner 15.

As shown, the liner 15 may be connected to the remainder of the helmet 1 by way of one or more connectors 20 of the present invention, discussed in further detail below. Selection of the location of the connectors 20 and the number of connectors 20 to use may depend upon the configuration of the remainder of the helmet. Accordingly, the present invention is not limited to the configuration depicted in FIG. 6.

In an arrangement such as shown in FIG. 6, at least one connector 20 may be connected to the inner shell 14. Alternatively or additionally, one or more of the connectors 20 may be connected to another part of the remainder of the helmet 1, such as the energy absorbing layer 3 and/or the outer shell 2. The connectors 20 may also be connected to two or more parts of the remainder of the helmet 1.

Figure 7:
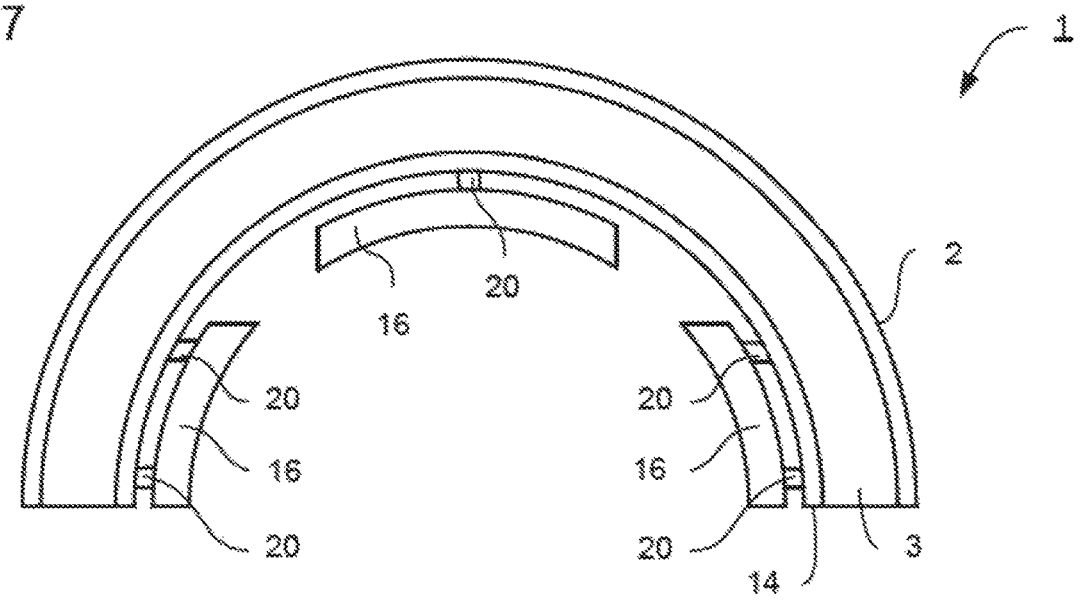
FIG. 7 depicts, in cross section, a helmet according to an embodiment of the present invention.

FIG. 7 depicts a further alternative arrangement of a helmet 1 using the connectors 20 of the present invention. As shown, the helmet 1 of this arrangement includes a plurality of independent sections of comfort padding 16. Each section of comfort padding 16 may be connected to the remainder of the helmet by one or more connectors 20 according to the present invention.

The sections of comfort padding 16 may have a sliding interface provided between the sections of comfort padding 16 and the remainder of the helmet 1. In such an arrangement, the sections of comfort padding 16 may provide a similar function to that of the liner 15 of the arrangement shown in FIG. 6. The options discussed above for provision of a sliding interface between a liner and a helmet also apply to the sliding interface between the sections of comfort padding and the helmet.

It should also be appreciated that the arrangement of FIG. 7, namely the provision of a plurality of independently mounted sections of comfort padding 16 provided with a sliding interface between the sections of comfort padding 16 and the remainder of the helmet, may be combined with any form of helmet, including those such as depicted in FIGS. 1 to 5 that also have a sliding interface provided between two other parts of the helmet.

Connectors 20 according to the present invention will now be described. For convenience, the connectors 20 will be described in the context of a connector for connecting a liner 15 to the remainder of a helmet 1 as depicted in FIG. 6. However, it should be appreciated that the connector 20 of the present invention may be used for connecting any two parts of an apparatus together. Furthermore, where below the connector 20 is described as having a first component connected to a first part of an apparatus, such as a helmet liner 15, and a second component connected to a second part of an apparatus, such as the remainder of the helmet 1, it should be appreciated that, with suitable modifications, this may be reversed.

Figure 8:
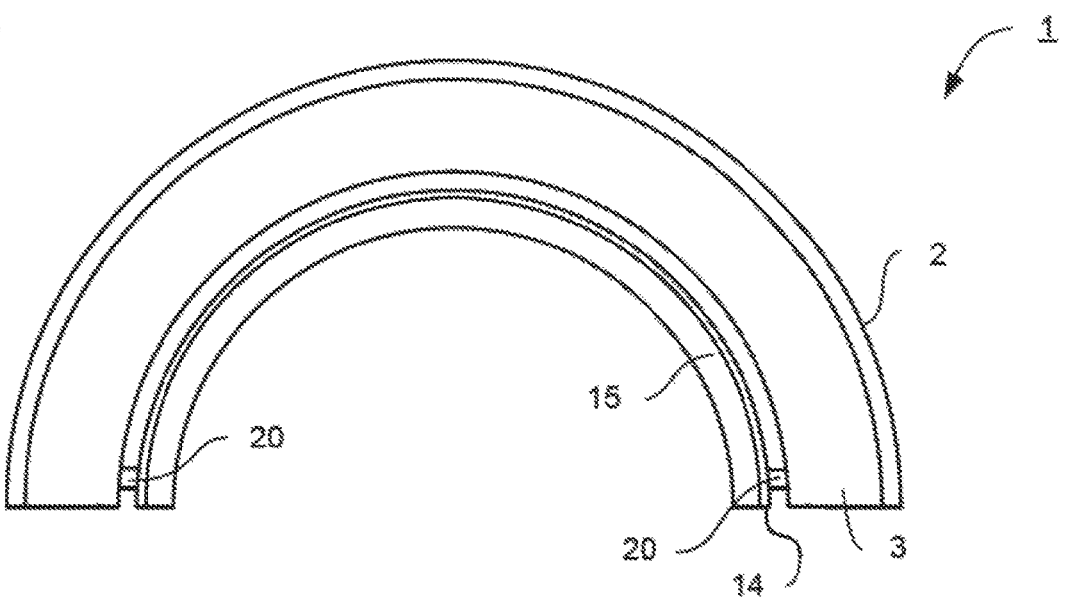
FIG. 8 depicts, in cross-section, a helmet according to another embodiment of the present invention.
Figure 9:
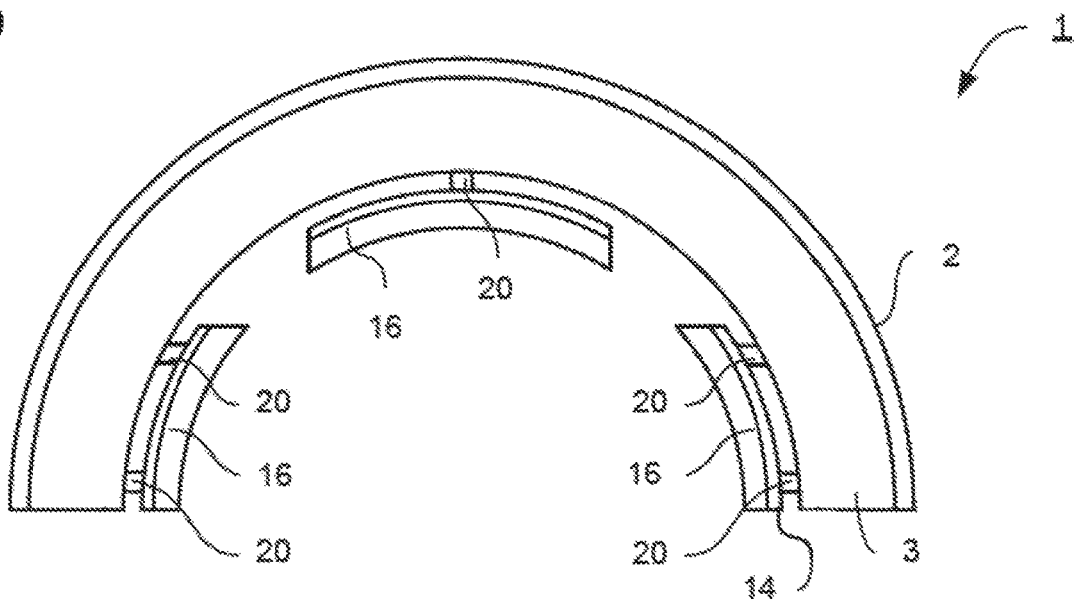
FIG. 9 depicts, in cross section, a helmet according to another embodiment of the present invention.

FIGS. 8 and 9 show equivalent embodiments to those of FIGS. 6 and 7, except that the inner shell 14 is applied to the liner 15 (in FIG. 8) or comfort padding 16 (in FIG. 9). In the case of FIG. 9, the inner shell 14 may only be a partial shell or a plurality of sections of shell, as compared to the substantially full shell arrangements of FIGS. 6 to 8. Indeed, in both FIGS. 8 and 9 the inner shell 14 may also be characterised as a relatively hard coating on the liner 15 or comfort padding 16. As for FIGS. 6 and 7, the inner shell 14 is formed from a relatively hard material, namely a material that is harder than the energy absorbing layer 3. For example, the material could be PTFE, ABS, PVC, PC, Nylon, PFA, EEP, PE and UHMWPE. The material may be bonded to the outer side of the liner 15 or comfort padding 16 to simplify the manufacturing process. Such bonding could be through any means, such as by adhesive or by high frequency welding.

In FIGS. 8 and 9 a low friction interface is provided between the inner shell 14 and the energy absorbing layer 3. This may be implemented by the appropriate selection of at least one of the material used to form the outer surface of the energy absorbing layer 3 or the material used to form the inner shell 14. Alternatively or additionally, a low friction coating may be applied to at least one of the opposing surfaces of the inner shell 14 and the energy absorbing layer 3. Alternatively or additionally, a lubricant may be applied to at least one of the opposing surfaces of the inner shell 14 and the energy absorbing layer 3.

In FIGS. 8 and 9, at least one connector 20 may be connected to the inner shell 14. Alternatively or additionally, one or more of the connectors 20 may be connected to another part of the remainder of the liner 15 or comfort padding 16.

Figure 10:
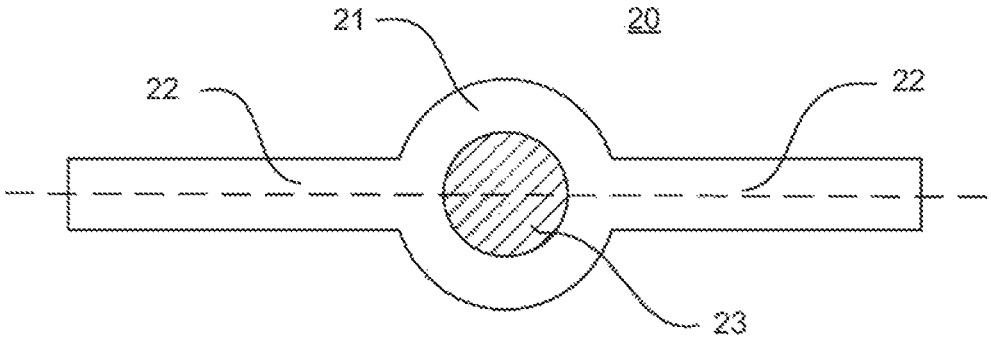
FIG. 10 depicts, a top (plan) view of a connector according to a first embodiment of the present invention.
Figure 11:
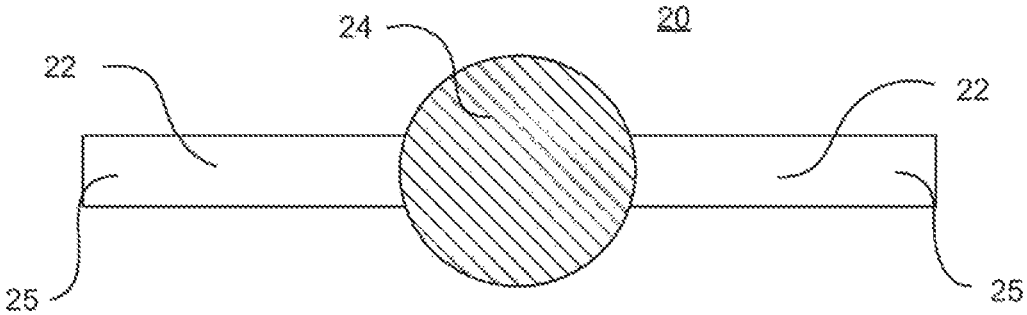
FIG. 11 depicts a bottom (plan) view, of this connector in FIG. 10.
Figure 12:
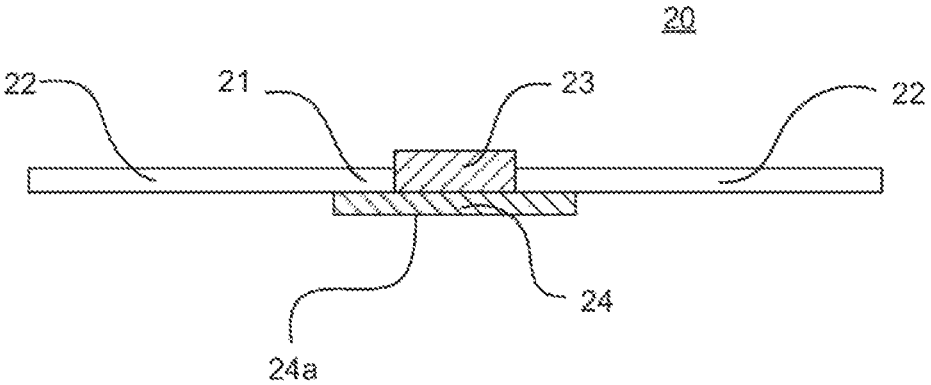
FIG. 12 depicts a cross-sectional side view of the connector in FIG. 10.

FIGS. 10, 11 and 12 respectively depict, a top view, a bottom view and a side view in cross-section (through the dashed lines in FIG. 10), of a first embodiment of a connector 20 according to the present invention that may be used to connect first and second parts of an apparatus, such as a helmet. In particular it may be configured to connect a liner 15 or comfort padding 16 to the remainder of a helmet.

In the arrangement depicted in FIG. 10, the connector 20 includes an inner region 21, and two arms 22 extending (e.g. outwardly) from an edge of the inner region 21. In the arrangement shown in FIGS. 10 and 11, the inner region 21 is substantially circular in shape as viewed from above. However, the inner region 21 is not limited to this shape. Any shape could be used instead, e.g. substantially square or substantially rectangular (with sharp or rounded corners), substantially elliptical or substantially oval.

The inner region 21 comprises an anchor point 23 (referred to as a "first" anchor point) on a first side thereof configured to connect the connector 20 to the first part of the apparatus. The first anchor point 23 is depicted in FIG. 10 in the form of a point at which one side of a hook and loop connector is attached (the other side being on the first part of the apparatus, e.g. a helmet). However, other methods of "detachable" attachment may be used, such as a snap-fit connection or a magnetic connector. Other forms of detachable connection may also be used.

Alternatively, the first anchor point 23 may be used for permanent attachment. For example, the first anchor point 23 may be in the form of a point at which the inner region 21 is attached by high frequency welding to the first part of the apparatus. However, other methods of 'permanent' or non-releasable attachment may be used, such using an adhesive or stitching.

Either type of attachment (detachable or permanent) may be configured such that it prevents translational movement of a first anchor point 23 relative to the part being connected to. However, it may be configured such that the first anchor point 23 and therefore the inner region 21 can rotate about one or more axes of rotation relative to the part being connected to. Alternatively or additionally, the first anchor point 23 may be connected to the parts to be connected by way of one or more additional components.

When viewed in plan view, the first anchor point 23 may be arranged substantially at the centre of the inner region 21. However, the present invention is not limited to a particular configuration.

The inner region 21 further comprises a sliding surface 24*a* on a second side thereof, opposite the first side, the sliding surface 24*a* being configured to provide a low friction interface between the inner region 21 and an opposing surface of the second part of the apparatus.

Figure 13:
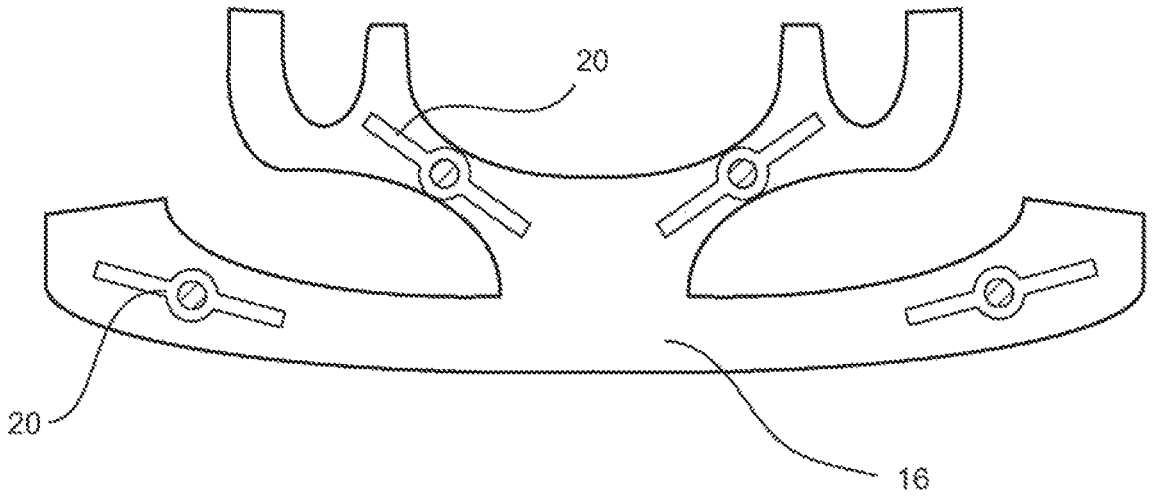
FIG. 13 depicts comfort padding comprising the connectors of FIG. 10.

FIG. 13 shows an example in which a layer of comfort padding 16 comprises a plurality of the connectors 20 depicted in FIGS. 10 to 12. In the arrangement depicted in FIG. 13, the sliding surface 24*a* of the connector 20 is provided adjacent to the surface of the second part, in this case the comfort padding layer 16, such that the sliding surface 24*a* may slide on the surface of the comfort padding layer 16 (e.g. translationally and/or rotationally with respect to a neutral position of the inner region 21).

In order to ensure that the sliding surface 24*a* can slide relative to the surface of the second part of the apparatus, a low friction interface may be provided between the opposing surfaces of the sliding surface 24*a* and the second part of the apparatus.

In this context, a low friction interface may be configured such that sliding contact is still possible even under the loading that may be expected in use. In the context of a helmet, for example, it may be desirable for sliding to be maintained in the event of an impact that is expected to be survivable for the wearer of a helmet. This may be provided, for example, by the provision of an interface between the two surfaces at which the coefficient of friction is between 0.001 and 0.3 and/or below 0.15.

In the present invention, a low friction interface may be implemented by at least one of using at least one low friction material for the construction of the element forming at least one of the opposing surfaces of the sliding surface and the surface of the second part of the apparatus, applying a low friction coating to at least one of the opposing surfaces, applying a lubricant to at least one of the opposing surfaces, and providing an unsecured additional layer of material between the opposing surfaces that has at least one low friction surface.

In the arrangement shown in FIGS. 10 to 12, the inner region 21 comprises a portion of deformable material integrally formed with the arms 22 and a plate 24 of relatively stiff material compared to the deformable material. The plate 24 may be formed from a sufficiently stiff material such that the plate 24 (and therefore, at least part of the inner region 21) substantially retains its shape during expected use of the apparatus. In the context of a helmet, this may include normal handling of the helmet and wearing the helmet under normal conditions. It may also include conditions including an impact on the helmet for which the helmet is designed with the expectation that the impact would be survivable for the wearer of the helmet.

The plate 24 may be made from a variety of different materials. In an example, the plate 24 may be made from polycarbonate (PC), polyvinylchloride (PVC), acrylonitrile butadiene styrene (ABS), polypropylene (PP), Nylon or another plastic. The plate may optionally have a thickness in the range of from approximately 0.2 mm to approximately 1.5 mm, for example approximately 0.7 mm thick.

The plate 24 may be substantially the same shape as the inner region as viewed in plan view. The deformable material of the inner region 21 may partially cover the plate 24 on one side. In the arrangement shown in FIGS. 10 to 12, the deformable material of the inner region 21 is ring shaped (annular) so as to cover one side of the periphery of the circular plate 24. The ring shape defines a circular through-hole in the deformable material. This through-hole allows the anchor point 23 to be directly connected to the plate 24, as shown in FIG. 12.

Other arrangements may be possible, however. For example, the deformable material may completely cover one side of the plate 24 (i.e. no through-hole is provided), in which case the anchor point 23 may be connected to the deformable material. Further, the deformable material of the inner region 21 may at least partially cover two opposing sides of the plate 24.

The plate 24 may be fixed to the deformable material by an adhesive, for example. Alternatively, the plate 24 may be co-moulded with the deformable material of the inner region 21. However, in some arrangements, the plate 24 may not be fixed to the deformable material. For example, with reference to FIG. 12, the anchor point 23 may be wider than the through-hole in the deformable material (or provided on a second plate wider than the through-hole) and located on the other side of the deformable material to the plate 24. The anchor point 23 and the plate 24 may be connected via the through-hole so as to sandwich the deformable material therebetween.

The arms 22 of the connector 20 are formed from a deformable material and configured to connect the connector 20 to the second part of the apparatus. In the arrangement of FIGS. 10 to 12, the arms 22 extend from mutually opposite sides of the inner region 21. However, other arrangements are possible instead. Further, the connector 20 is not limited to having two arms 22. For example, three, four, or more arms 22 may be provided. The arms may be arranged symmetrically, for example, (e.g. at regular intervals around the edge of the inner region 21).

As shown in FIGS. 10 to 12, each arm 22 may extend in a direction substantially parallel to the sliding surface 24*a* of the inner region 21. However, other arrangements may be possible. For example, the arms 22 may extend at an angle to the siding surface 24*a* of the inner region 21. In that case, the arms 22 may extend in away from the inner region 21 towards the side of the connector 20 on which the anchor point 23 is provided or towards a side of the connector 20 on which the sliding surface 24*a* is provided. In the arrangement shown in FIGS. 10 to 12, each arm 22 may further comprise an anchor point 25 (referred to as a "second" anchor point to distinguish from the first anchor point 23 of the inner region 21) for connecting the arm 22 to the second part of the apparatus. The second anchor point 25 may be located at a distal end of each arm 22, as indicated in FIG. 11.

The second anchor point 25 may be used for permanent attachment. For example, the anchor point 25 may be in the form of a point at which the arms 22 are attached by adhesive to the first part of the apparatus. The arms 22 may include a groove or ridge running substantially perpendicular to the extension direction of the arms 22 to provide a barrier to prevent adhesive spreading from the distal end of the arms 22 towards the inner region. Other methods of 'permanent' or non-releasable attachment may alternatively be used, such as using high frequency welding or stitching.

Alternatively, the second anchor point 25 may be in the form of a detachable anchor point, e.g. point at which one side of a hook and loop connector is attached (the other side being on the second part of the apparatus). However, other methods of 'detachable' attachment may be used, such as a snap-fit connection or a magnetic connector.

FIG. 13 depicts a comfort padding layer 16 comprising a plurality of the connectors 20 depicted in FIGS. 10 to 12. Although the comfort padding layer 16 is shown as being flat, i.e. in the plane of the page, when the layer 16 is positioned within the rest of the helmet, the comfort padding layer 16 bends to conform to the concave shape of the inner surface of the rest of the helmet.

The arms 22 of the connectors 20 are configured to be connected to a surface of the second part of the apparatus forming the sliding interface with the sliding surface of the inner region 21, so as to be substantially parallel with said surface of the second part of the apparatus, as shown in FIG. 13. However, other arrangements are possible. For example, the arms 22 may be arranged to wrap around a portion of the second part of the apparatus and attach to a surface of the second part of the apparatus opposite the surface forming the sliding interface. This arrangement is similar to that described below in relation to FIG. 17.

When attached to the second part of the apparatus, the arms 22, formed from the deformable material, are configured to bias the inner region 21 towards a first position, such that when the inner region 21 is displaced away from the first position (e.g. by sliding along a low friction interface) the arms 22 of deformable material urge the inner region 21 back into the first position.

As the sliding surface 24*a* of the connector 20 slides over the surface of the second part of apparatus (e.g. during an impact), the inner region 21 moves relative to the surface of the second part of the apparatus and deforms the arms 22. As such, the arms 22 define a (neutral) natural resting position of the inner region 21 relative to the first and second parts of the surrounding apparatus to which they connect via the anchor points 23, 25. However, by deformation of the deformable material during displacement of the inner region 21, for example stretching of one side of the deformable material, the inner region 21 is permitted to slide. In doing so, the first part of the apparatus, such as the remainder of the helmet, which may be connected to the first anchor point 23, may slide relative to the first part of the apparatus, such as the liner 15, connected to the second anchor point 25.

A connector 20 of the present invention may be configured to permit a desired relative range of movement of the inner region 21, and therefore the relative range of movement between the first part of the apparatus and the second part of the apparatus being connected.

Such configuration may be achieved by the selection of the material forming the arms 22, the thickness of the material forming the arms 22 and the number and location of the arms 22. For example, a connector 20 for use within a helmet may be configured to enable a relative movement of the inner region 21 to the surface of the second part of the apparatus of approximately 5 mm or more in any direction within a plane parallel to the sliding surface of the inner region 21.

The arms 22 can be formed of material that deforms substantially elastically for the required range of movement of the inner region 21 relative to the second part of the apparatus. For example, the deformable material may be formed from at least one of an elasticated fabric, an elasticated cloth, an elasticated textile and an elastomeric material, e.g. a elastomeric polymeric material such as silicone/polysiloxane.

The deformable material may be formed as a single piece, by moulding for example, or may be formed by connecting together multiple pieces, e.g. an upper layer and a lower layer, subsequently joined.

Figure 14:
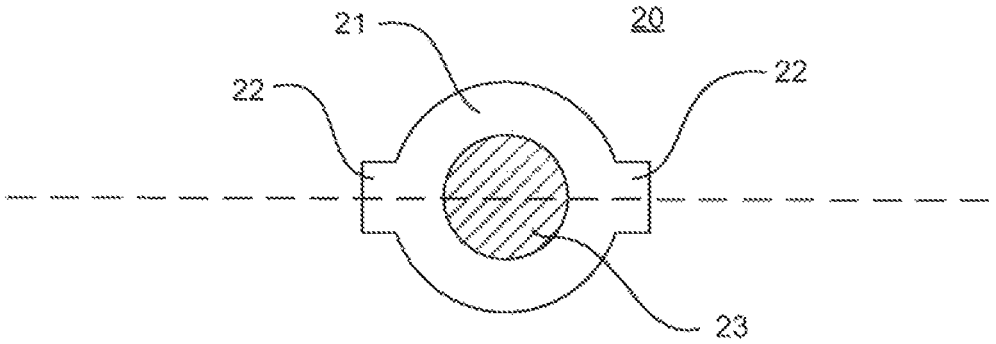
FIG. 14 depicts a top (plan) view of a connector according to a second embodiment of the present invention.
Figure 15:
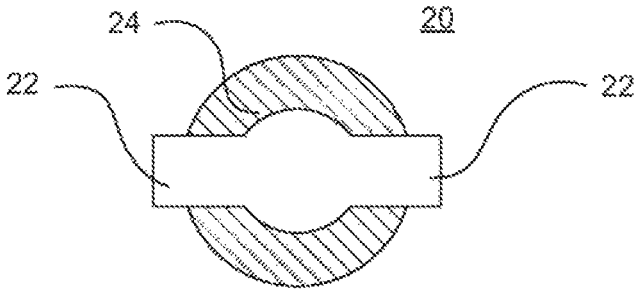
FIG. 15 depicts a bottom (plan) view, of this connector in FIG. 14
Figure 16:
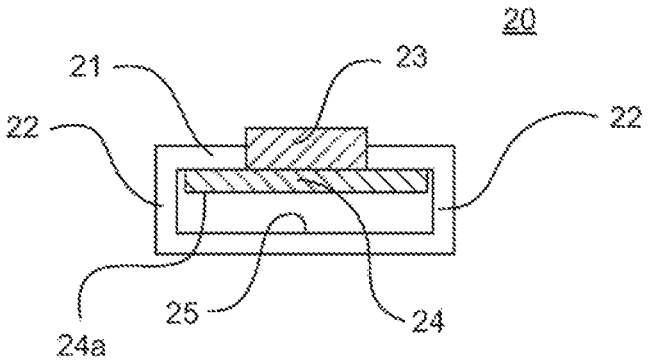
FIG. 16 depicts a cross-sectional side view of the connector in FIG. 14.

FIGS. 14, 15 and 16 respectively depict, a top view, a bottom view and a side view in cross-section (through the dashed lines in FIG. 14), of a second embodiment of a connector 20 according to the present invention that may be used to connect first and second parts of an apparatus, such as a helmet. In particular it may be configured to connect a liner 15 or comfort padding 16 to the remainder of a helmet.

In the arrangement depicted in FIG. 14, the connector 20 includes an inner region 21, and two arms 22 extending outward from an edge of the inner region 21. The inner region 21 of the second embodiment is identical to the inner region 21 of the first embodiment depicted in FIGS. 10 to 12. However, the arms 22 are different to the arms of the first embodiment. Therefore, only the arms 22 will be described in detail below.

Similarly to the previous embodiment, the arms 22 of the connector 20 are formed from a deformable material and configured to connect the connector 20 to the second part of the apparatus. In the arrangement of FIGS. 14 to 16, the arms extend from mutually opposite sides of the inner region 21. However, other arrangements are possible instead. Further, the connector 20 is not limited to having two arms 22. For example, three, four, or more arms 22 may be provided. The arms, may be arranged symmetrically, for example, e.g. at regular intervals around the edge of the inner region 21.

As shown in FIGS. 14 to 16, each arm 22 extends away from the first anchor point and joins with the other arm 22 to form a closed loop on the opposite side of the inner region 21 to the first anchor point 23. The closed loop is configured to loop around a portion of the second part of the apparatus. The loop may be formed from a plurality of substantially straight sections, the sections being angled with respect to each other (e.g. as shown in FIG. 16) and/or may be formed from one or more curved sections.

In the arrangement shown in FIGS. 14 to 16, the arms 22 may further comprise an anchor point 25 (referred to as a "second" anchor point to distinguish from the first anchor point 23 of the inner region) for connecting the arms 22 to the second part of the apparatus. The connector 20 may have only one second anchor point 25.

The second anchor point 25 may be arranged on the loop formed by the arms 22 at a location opposite and facing the inner region 21 and may be configured to connect to a surface of the second part of the apparatus opposite the surface forming the sliding interface. In other words, the connector 20 may be attached to the inside of the second part of the apparatus, the sliding interface being provided on the outside of the second part of the apparatus. As shown in FIG. 15, the arms 22 may comprise a relative wide portion at the location of the second anchor point to allow for a larger anchor point 25. This relatively wide portion may be substantially circular in shape, for example, as shown in FIG. 15.

The second anchor point 25 may be used for permanent attachment. For example, the anchor point 25 may be in the form of a point at which the arms 22 are attached by adhesive to the first part of the apparatus. The arms 22 may include grooves or ridges running substantially perpendicular to the extension direction of the arms 22 to provide a barrier to prevent adhesive spreading from the second anchor point 25 towards the inner region 21. Other methods of 'permanent' or non-releasable attachment may alternatively be used, such as using high frequency welding or stitching.

Alternatively, the second anchor point 25 may be in the form of a detachable anchor point, e.g. point at which one side of a hook and loop connector is attached (the other side being on the second part of the apparatus). However, other methods of 'detachable' attachment may be used, such as a snap-fit connection or a magnetic connector.

In examples having more than two arms 22, each of the arms may join together at the same point, i.e. the second anchor point 25.

Figure 17:
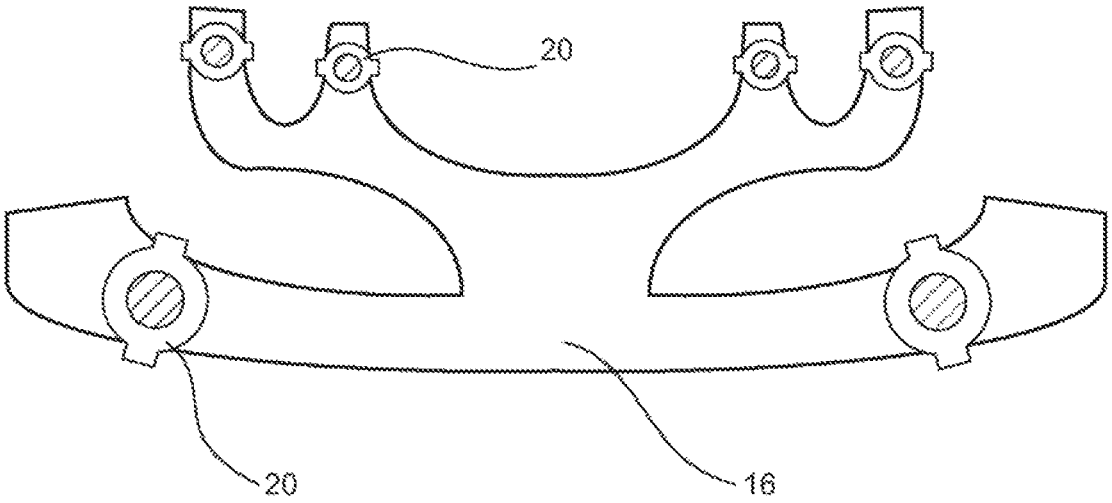
FIG. 17 depicts comfort padding comprising the connectors of FIG. 14.

FIG. 17 depicts a comfort padding layer 16 comprising a plurality of the connectors 20 depicted in FIGS. 14 to 16. Although the comfort padding layer 16 is shown as being flat, i.e. in the plane of the page, when the layer 16 is positioned within the rest of the helmet, the layer 16 bends to conform to the concave shape of the inner surface of the rest of the helmet.

When attached to the second part of the apparatus, the arms 22, formed from the deformable material, are configured to bias the inner region 21 towards a first position, such that when the inner region 21 is displaced away from the first position (e.g. by sliding along a low friction interface) the arms 22 of deformable material urge the inner region 21 back into the first position.

As the sliding surface 24*a* of the connector 20 slides over the surface of the second part of apparatus (e.g. during an impact), the inner region 21 moves relative to the surface of the second part of the apparatus and deforms the arms 22. As such, the arms 22 define a (neutral) natural resting position of the inner region 21 relative to the first and second parts of the surrounding apparatus to which they connect via the anchor points 23, 25. However, by deformation of the deformable material 23 during displacement of the inner region 21, for example stretching of one side of the deformable material, the inner region 21 is permitted to slide. In doing so, the first part of the apparatus, such as the remainder of the helmet, which may be connected to the first anchor point 23, may slide relative to the first part of the apparatus, such as the liner 15, connected to the second anchor point 25.

A connector 20 of the present invention may be configured to permit a desired relative range of movement of the inner region 21, and therefore the relative range of movement between the first part of the apparatus and the second part of the apparatus being connected.

Such configuration may be achieved by the selection of the material forming the arms 22, the thickness of the material forming the arms 22 and the number and location of the arms 22. For example, a connector 20 for use within a helmet may be configured to enable a relative movement of the inner region 21 to the surface of the second part of the apparatus of approximately 5 mm or more in any direction within a plane parallel to the sliding surface of the inner region 21.

The arms 22 can be formed of material that deforms substantially elastically for the required range of movement of the inner region 21 relative to the second part of the apparatus.

For example, the deformable material may be formed from at least one of an elasticated fabric, an elasticated cloth, an elasticated textile and an elastomeric material, e.g. an elastomeric polymeric material such as silicone/polysiloxane.

The deformable material may be formed as a single piece, by moulding for example, or may be formed by connecting together multiple pieces, e.g. an upper layer and a lower layer, subsequently joined.

FIGS. 18, 19 and 20 respectively depict, a top view, a bottom view and a side view in cross-section (through the dashed lines in FIG. 18), of a third embodiment of a connector 20 according to the present invention that may be used to connect first and second parts of an apparatus, such as a helmet. In particular it may be configured to connect a liner 15 or comfort padding 16 to the remainder of a helmet.

In the arrangement depicted in FIG. 18, the connector 20 includes an inner region 21, and two arms 22 extending outward from an edge of the inner region 21. The arms 22 of the third embodiment are substantially the same as the arms 22 of the second embodiment depicted in FIGS. 14 to 16. Minor differences between the arms 21 of the second and third embodiments will be described below. However, the inner region 21 is different to the inner region 21 of the first and second embodiments.

In the arrangement shown in FIGS. 18 and 19, the inner region 21 is substantially circular in shape as viewed from above. However, the inner region 21 is not limited to this shape. Any shape could be used instead, e.g. substantially square or substantially rectangular (with sharp or rounded corners), substantially elliptical or substantially oval.

The inner region 21 comprises a first anchor point 23 on a first side thereof configured to connect the connector 20 to the first part of the apparatus. The first anchor point 23 is the same as described previously in relation to the first and second embodiments and FIGS. 10 to 12 and 14 to 16.

The inner region 21 further comprises a sliding surface 24*a* on a second side thereof, opposite the first side, the sliding surface 24*a* being configured to provide a low friction interface between the inner region 21 and an opposing surface of the second part of the apparatus. The sliding surface 24*a* is the same as described previously in relation to the first and second embodiments and FIGS. 10 to 12 and 14 to 16.

The inner region 21 of the arrangement shown in FIGS. 18 to 20 differs from the inner region 21 of the arrangement shown in FIGS. 10 to 12 and 14 to 16 in that the inner region 21 does not comprises a portion of deformable material integrally formed with the arms 22. Instead, the inner region 21 of this embodiment comprises a plate 24 of relatively stiff material compared to the deformable material, connected to the arms 22.

In the arrangement shown in FIGS. 18 to 20, the plate 24 comprises protrusions 26 extending from an edge of the inner region 21 (parallel to the plate 24) and the plate 24 is connected to the arms 22 via the protrusions 26. The plate 24 may otherwise be the same as described in relation to the previous embodiments and FIGS. 10 to 12 and 14 to 16.

The deformable material of the arms 22 may at least partially cover two opposing sides of the protrusions 26. In the arrangement shown in FIGS. 18 to 20, the deformable material of the arms 22 forms a slot 27, surrounded on all sides by the deformable material, into which the protrusions 26 are inserted. Other arrangements may be possible, however. For example, the deformable material of the arms 22 may at least partially cover the protrusions 26 only on one side.

The protrusions 26 may be fixed to the deformable material of the arms 22 by an adhesive, for example, as depicted in FIG. 12. Alternatively, the protrusions 26 may be co-moulded with the deformable material of the arms 22

In yet a further embodiment, not shown in the Figures, the inner region 21 of the third embodiment may be combined with the arms 22 of the first embodiment, i.e. arms extending away from the inner region 21 but not forming a closed loop.

Although in each of the specific embodiments described above the inner region comprises a relatively stiff plate 24 which provides the sliding surface 24*a*, alternative arrangements are possible. For example, the sliding surface 24*a* may be provided by a flexible material, such as a layer of fabric (woven or nonwoven). The flexible material may be exchanged, like-for-like, with the plate 24 in any of the above described embodiments. In such arrangements, the flexible material would not be provided on the surface of the arms 22. However, the flexible material may additionally be provided on the surface of the arms 22 facing the second part of the apparatus, e.g. as one continuous layer. Accordingly, the sliding interface may not only be provided between the inner region 21 and the surface of the second part of the apparatus, but also between the surface of the arms 22 and the surface of the second part of the apparatus.

It should be understood that the term arm is meant in its normal sense, i.e. a structure comparable to an arm in form—for example, something that projects from a larger structure (i.e. the inner region 21). Specifically, the arms 22 may be elongate, i.e. relatively narrow in width compared to their length.

The width direction of an arm 22 is the direction perpendicular to the extension direction of the arm 22 from the inner region 21 and parallel to the sliding surface 24*a*, i.e. vertically in FIG. 10.

In each of the above examples, the arms 22 are substantially narrower in width than the inner region 21, as shown in the Figures. Accordingly, the arms 22 are recognisably distinct from the inner region 21 by virtue of their width. It should be understood that in some examples the arms 22 may smoothly transition into the wider inner region 21, while still remaining recognisably distinct from the inner region 21.

In some embodiments the arms 22 form a closed loop and could be regarded as a single element, nevertheless two arms 22 are still recognisable as extending from the inner region 21.

This is because the deformable material projects from the inner region 21 at two locations.

The connectors 20 of the present invention may be used in combination with a different type of connector to connect the first and second parts of the apparatus. For example, the connectors 20 may be used in combination with the connectors described in WO 2017/157765 or GB 1719559.5, which are herein incorporated in their entirety by reference.

The invention claimed is:

1. A connector for connecting first and second parts of an apparatus, comprising:

an inner region comprising a first anchor point on a first side thereof, the first anchor point being configured to connect the connector to the first part of the apparatus;

two, or more, arms extending from an edge of the inner region, the arms being formed from a deformable material and configured to connect the connector to the second part of the apparatus; and the inner region further comprising a sliding surface on a second side thereof, opposite the first side, the sliding surface being configured to provide a low friction interface between the inner region and an opposing surface of the second part of the apparatus wherein the arms of deformable material are configured to bias the inner region towards a first position, such that when the inner region is displaced away from the first position by sliding along the low friction interface, the arms of deformable material urge the inner region back into the first position.

2. The connector according to claim 1, wherein the arms extend from mutually opposite sides of the inner region.

3. The connector according to claim 1, wherein each arm extends in a direction substantially parallel to the sliding surface of the inner region, optionally, wherein each arm further comprises a second anchor point for connecting the arm to the second part of the apparatus.

4. The connector according to claim 1, wherein each arm extends away from the first anchor point and joins with the other arm to form a closed loop on the opposite side of the inner region to the first anchor point, the closed loop configured to loop around a portion of the second part of the apparatus, optionally, either of the arms comprise a second anchor point arranged opposite and facing the inner region configured to connect to a surface of the second part of the apparatus opposite the surface forming the low friction interface, or the arms are configured to loop around a portion of the second part of the apparatus to connect the connector thereto without a further anchor point for connecting the arms to the second part of the apparatus.

5. The connector according to claim 1, wherein the inner region comprises a portion of deformable material integrally formed with the arms and a plate of relatively stiff material compared to the deformable material, optionally, wherein the deformable material of the inner region at least partially covers one side of the plates, or the deformable material of the inner region at least partially covers two opposing sides of the plate.

6. The connector according to claim 1, wherein the inner region comprises a plate of relatively stiff material compared to the deformable material, connected to the arms, optionally, wherein the plate comprises protrusions extending from an edge of the inner region and the plate is connected to the arms via the protrusions, optionally, wherein the deformable material of the arms at least partially covers one side of the protrusions or the deformable material of the arms at least partially covers two opposing sides of the protrusions.

7. The connector according to claim 5, wherein the plate is fixed to the deformable material by an adhesive or the plate is co-moulded with deformable material or the plate is not fixed to the deformable material.

8. The connector according to claim 5, wherein the first anchor point is directly connected to the plate.

9. The connector according to claim 1, wherein the deformable material is substantially elastically deformable, optionally, wherein the deformable material comprises an elasticated fabric, cloth or textile, or an elastomeric material, optionally, wherein the deformable material is a silicone elastomer.

10. The connector according to claim 1, wherein the low friction interface is implemented by at least one of using at least one low friction material for the construction of the element forming at least one of the opposing surfaces, applying a low friction coating to at least one of the opposing surfaces, applying a lubricant to at least one of the opposing surfaces, and providing an unsecured additional layer of material between the opposing surfaces that has at least one low friction surface.

11. The connector according to claim 1, wherein at least one second anchor point is configured to be detachably connected to the first part of the apparatus, optionally, wherein the at least one second anchor point is configured to be detachably connected by at least one of a hook and loop connection, a snap-fit connection and a magnetic connection.

12. The connector according to claim 1, wherein at least one second anchor point is configured to be non-releasably connected to the first part of the apparatus, optionally, wherein the at least one second anchor point is configured to be connected by an adhesive, stitching, or high frequency welding.

13. The connector according to claim 1, wherein the first anchor point is configured to be detachably connected to the first part of the apparatus, optionally, wherein the first anchor point is configured to be detachably connected by at least one of a hook and loop connection, a snap-fit connection and a magnetic connection.

14. The connector according to claim 1, wherein the first anchor point is configured to be non-releasably connected to the first part of the apparatus, optionally, wherein the first anchor point is configured to be connected by an adhesive, stitching, or high frequency welding.

15. The connector according to claim 1, the connector further comprising one or more further arms extending outward from the edge of the inner region, the arms being formed from the deformable material and configured to connect the connector to the second part of the apparatus.

16. A liner for a helmet, comprising at least one connector according to claim 1 connected thereto, optionally, wherein the first anchor point of the at least one connector is configured to be connected to the helmet, optionally, wherein the liner comprises comfort padding and optionally a layer of relatively hard material, compared to the comfort padding, provided more outwardly than the comfort padding.

17. A helmet, comprising a liner according to claim 16, optionally, wherein the liner is removable from the helmet, optionally, wherein the first anchor point of the at least one connector is connected to at least one of a relatively hard outer shell of the helmet, an energy absorbing layer of material in the helmet and a relatively hard layer of material provided more inwardly within the helmet than the energy absorbing material of the helmet, optionally, the helmet in turn, an outer shell formed from a relatively hard material, one or more layers of energy absorbing material, an inner shell formed from a relatively hard material and the liner, optionally, wherein a low friction interface is provided between the energy absorbing material and the inner shell, optionally, wherein the low friction interface is implemented by at least one of using at least one low friction material for the construction of the inner shell and the energy absorbing material, applying a low friction coating to at least one of the opposing surfaces of the inner shell and the energy absorbing material, and applying a lubricant to at least one of the opposing surfaces of the inner shell and the energy absorbing material, optionally, wherein the first anchor point is attached to the helmet by a hook and loop connection.

18. A helmet according to claim 17, comprising a plurality of independent sections of comfort padding, each mounted to the helmet by at least one connector according to claim 1.

19. A helmet comprising in turn:

an outer shell formed from a relatively hard material, one or more layers of energy absorbing material, and a liner or a plurality of sections of comfort padding;

at least one connector according to claim 1 connecting the liner or a section of comfort padding to the rest of the helmet;

wherein a relatively hard coating is bonded to the outer surface of the liner or plurality of sections of comfort padding, to form a low friction interface between the relatively hard coating and the energy absorbing layer.

* * * * *